US009222655B2

(12) United States Patent
Radermacher

(10) Patent No.: US 9,222,655 B2
(45) Date of Patent: Dec. 29, 2015

(54) MODULAR LIGHTING SYSTEM

(71) Applicant: KONINKLIJKE PHILIPS N.V., Eindhoven (NL)

(72) Inventor: Harald Joseph Gunther Radermacher, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/343,282

(22) PCT Filed: Sep. 28, 2012

(86) PCT No.: PCT/IB2012/055184

§ 371 (c)(1),
(2) Date: Mar. 6, 2014

(87) PCT Pub. No.: WO2013/050913

PCT Pub. Date: Apr. 11, 2013

(65) Prior Publication Data

US 2014/0233232 A1 Aug. 21, 2014

Related U.S. Application Data

(60) Provisional application No. 61/543,828, filed on Oct. 6, 2011.

(51) Int. Cl.

| | |
|---|---|
| ***F21V 21/00*** | (2006.01) |
| ***F21V 23/00*** | (2015.01) |
| ***F21S 2/00*** | (2006.01) |
| ***F21V 23/06*** | (2006.01) |
| *F21V 31/00* | (2006.01) |
| *F21V 21/005* | (2006.01) |
| *F21V 23/04* | (2006.01) |
| *F21Y 101/02* | (2006.01) |

(52) U.S. Cl.
CPC ..... *F21V 23/003* (2013.01); *F21S 2/005* (2013.01); *F21V 23/06* (2013.01); *F21V 21/005* (2013.01); *F21V 23/008* (2013.01); *F21V 23/04* (2013.01); *F21V 31/005* (2013.01); *F21Y 2101/02* (2013.01)

(58) Field of Classification Search
USPC ..... 362/249.01, 249.02, 249.12, 362
See application file for complete search history.

(56) References Cited

U.S. PATENT DOCUMENTS

| | | | | |
|---|---|---|---|---|
| 5,404,282 | A * | 4/1995 | Klinke et al. | 362/249.06 |
| 7,033,060 | B2 | 4/2006 | Dubuc | |
| 8,637,882 | B2 * | 1/2014 | Stoyan | 257/98 |

(Continued)

FOREIGN PATENT DOCUMENTS

| | | | |
|---|---|---|---|
| CN | 201661928 | U | 12/2010 |
| CN | 201666507 | U | 12/2010 |
| CN | 201757336 | U | 3/2011 |
| EP | 1519106 | A2 | 3/2005 |
| EP | 1980785 | A | 10/2008 |

(Continued)

*Primary Examiner* — Thuy Vinh Tran
(74) *Attorney, Agent, or Firm* — Meenakshy Chakravorty

(57) ABSTRACT

The invention proposes a lighting system comprising a plurality of modules, the modifies respectively comprising: a housing provided with an exit window; at least one light source provided in the housing; wherein the lighting system further comprises: a controller arranged to drive light sources, an electrical circuit arranged to connect light sources with the controller, the electrical circuit further comprising a first pair of electrical contacts provided in a first module and a second pair of electrical contacts provided in a second module, the first and second pair of contacts being arranged for a mutual electrical connection.

13 Claims, 3 Drawing Sheets

(56) References Cited

U.S. PATENT DOCUMENTS

| | | | | |
|---|---|---|---|---|
| 8,845,130 | B2 * | 9/2014 | Gingrich, III | 362/249.02 |
| 2003/0063463 | A1 * | 4/2003 | Sloan et al. | 362/238 |
| 2006/0262533 | A1 * | 11/2006 | Lin et al. | 362/249 |
| 2010/0237805 | A1 | 9/2010 | Yamazaki et al. | |
| 2011/0101868 | A1 | 5/2011 | Weiss | |
| 2011/0136390 | A1 | 6/2011 | Gingrich, III | |

FOREIGN PATENT DOCUMENTS

| | | | |
|---|---|---|---|
| FR | 2859270 | A1 | 3/2005 |
| FR | 2922295 | A1 | 4/2009 |
| JP | 2011040414 | A | 2/2011 |
| WO | 2005024291 | A2 | 3/2005 |
| WO | 2009141287 | A1 | 11/2009 |
| WO | 2010139179 | | 12/2010 |

* cited by examiner

MODULAR LIGHTING SYSTEM

CROSS-REFERENCE TO RELATED APPLICATIONS

This application is the U.S. National Phase application under 35 U.S.C. §371 of International Application No. PCT/IB2012/055184, filed on Sep. 28, 2012, which claims the benefit of U.S. Provisional Application No. 61/543,828, filed on Oct. 6, 2011. These applications are hereby incorporated by reference herein.

FIELD OF THE INVENTION

The invention relates to a lighting system and a module for a lighting system.

BACKGROUND OF THE INVENTION

A lighting system comprising modules which are respectively provided with light source, such as solid state-based light source, e.g. light emitting diodes (so-called LED), is known from the Chinese patent application CN201661928. That document discloses a lighting system comprising a frame, a controller and a number of modules. Each module comprises a LED. A number of modules are attached to the frame. In the lighting system the controller is connected to the LEDs for driving the LEDs.

Lighting systems can be provided with LEDs. These lighting systems can be used for street lighting or other public places. Street lighting can be a demanding application for the known lighting system comprising LEDs or other solid state light sources. A lighting system for street lighting requires a quite high flux in the range of 5-25 klm and a granularity of about 2 klm. A wished total light flux of the lighting system can be obtained by adding sufficient LEDs or modules to the lighting system.

Furthermore, the conventional lighting system provided with the LEDs suffers from a decreasing light output during the lifetime due to ageing of the LEDs. In order to maintain a required minimum level of illumination level although the light output value of the individual LEDs has been degraded (e.g. 70%) from the initial value it is known to use spare LEDs besides the other LEDs used from an initial installation. These spare LEDs can be switched on and their light output controlled after a certain period of accumulated operation time of the lighting system in order to compensate for the lumen depreciation of said other LEDs. The spare LEDs makes the lighting system more expensive, in particular because the spare LEDs and their control systems are relatively expensive in comparison with to the projected price of LEDs at a point of time in the future when the spare LEDs in the lighting system will be actually used.

Moreover, these spare LEDs and associated controllers add complexity and weight to the lighting system.

SUMMARY OF THE INVENTION

It is an object of the invention to provide a cost-effective lighting system.

Another object of the invention is to provide a lighting system which is scalable and more flexible, especially over time to allow an easy modification of the lighting system in real time—i.e. when additional light will be needed (e.g. when the illumination of the initial lighting system has been degraded).

Another object of the invention is to provide a lighting system which is scalable and more flexible, especially over time to adapt or change the illumination according to the change of the needs and/or to compensate a light degradation.

According to a first aspect of the invention this and other objects are achieved by a lighting system according to claim 1.

Optionally the first and second connectors are arranged to cooperate so as to releasibily mount the first and second modules electrically and mechanically to each other.

Light source may be any kind of light source, such as incandescent lamp, fluorescent lamp or solid-state lighting, such as for example one or several LEDs.

The invention is based on the insight that combining the mechanical and the electrical connections of the modules in the first and the second connectors enables easy addition or replacing of modules during installation and/or maintenance of the lighting system. The number of modules can be easily extended in order to obtain a wished light output in combination with a certain granularity during the life time of the lighting system. Furthermore, this arrangement allows a lighting system with a reduced number of light source at the time of installation, because additional light source s in additional modules can be easily added at later point in time, for example, during regular maintenance for cleaning and checking the lighting system. The additional modules are expected to be less expensive at the time of maintenance. So, the cost of ownership of the lighting system will decrease.

Furthermore, for example, the first connector can be a screw and the second connector can be a screw nut. Alternatively, the first connector and the cooperating second connector may be of a bayonet type. This kind of connectors enables easy installation of the modules.

In a further embodiment the first module comprises a third connector provided with a third pair of electrical contacts, and optionally positioned on a side of the housing opposite the side where the first connector is provided. The third connector and third pair of electrical contact in the first module may be similar or identical to the second connector and the second pair of contacts in the second module. In this arrangement a lighting system comprising a chain of first and second modules may therefore be assembled.

This further embodiment allows also to provide standardized modules, which can be connected one to the other whatever their own industrial references are. Costs of manufacturing and (accordingly) the price per module can also be significantly decreased if each module is identical one to the other.

In a further embodiment the first connector and the third connector are integrally formed in a peripheral wall of the housing of the first module. This integration of the first and second connectors in the housing enables a rigid chaining of the modules.

In a further embodiment a sealing is provided between the first connector and the cooperating second connector. The sealing can be, for example, an O-ring of a resilient material for example rubber and enables a waterproof and dustproof connection of the modules. In addition, at least one of the connectors is designed such that the lighting system is sealed at this connector as long as no further module is connected at that connector. Once a further module is connected, the last module and/or the sealing result in a continuous sealing of the lighting system.

In a further embodiment of the lighting system, the electrical circuit comprises an electrical conductor between the electrical contacts of the second pair of the second module. For example, a module of the lighting system at an end of a chain of modules can be provided with this electrical conductor that electrically connects the light source in this last module directly to the controller, so that the controller can drive the light source in a constant current mode.

In a further embodiment the lighting system comprises a device arranged to generate a signal indicating a required load in the lighting system. The device may be, for example, a multiple switch the total electrical load and/or the total number of light sources to be driven in the lighting system is selected. This total number and/or total load can be adapted when a further module is added to the lighting system. The generated signal informs the controller on the required load in the lighting system.

The power of the light source is also dependent on the electrical load and/or number and arrangement (parallel, series or series-parallel) of the light sources. For example, the controller can be arranged to detect automatically the number of light sources and the type of modules connected in the lighting system and to drive the light sources in dependence on the characteristics, the type and the arrangement of the light sources. For example, the controller can be arranged to detect automatically the overall new electrical load of the lighting system, once a new module has been mounted, and to drive the light sources accordingly, based on illumination criteria.

In a further embodiment the controller is arranged to receive said signal, and to adjust the power to the light source accordingly. In this arrangement the power of the light source can be adjusted according to a characteristic of a light source to be driven in the first and second modules.

In a further embodiment the lighting system comprises a device arranged to accumulate the operating time of the lighting system, a memory to store the accumulated life time and wherein the controller is further arranged to adjust the power of the light source in the lighting system in dependence on the accumulated operation time of the lighting system. In this arrangement the power to the light source can be increased after a certain period of accumulated operation time in order to compensate for ageing of the light source.

In a further embodiment the light output of a module is one of 1, 3, 5, 10 or 20 klm.

In a further embodiment, each module comprises:

- a controller (2) arranged to drive the light source(s) of the module (5,35);
- an electrical circuit (13; 43) arranged to connect the light source(s) of the module with the controller of the module, the electrical circuit further comprising at least one pair of electrical contacts provided for implementing an electrical connection with a pair of electrical contacts of another module.

The invention further relates to a module for use in said lighting system, as provided in claim 13.

Optionally the first and second connectors are arranged to cooperate so as to releasibily mount the first and second modules electrically and mechanically to each other.

In a further embodiment the housing is provided with a removable portion in a peripheral wall of the housing for releasing the first and/or second connector part. By removing this portion from the module, the first connector part of the first module can be connected with the second connector part of the second module. The removable portion can be taken out from the first module for example, by engaging the first connector of the first module in the second connector of the second module. In a module connected at en end of a chain of modules the removable portion remains present in the peripheral wall waterproof and dustproof sealing of the lighting system.

In a further embodiment the electrical circuit comprises an electrical conductor between the electrical contacts of the first and/or second pair of electrical contacts.

In a further embodiment the first connector is arranged such that it would be electrically, mechanically and cooperatively connectable to the second connector if the first module would be said further module. In this way a number of modules can be assembled together to form a lighting system.

These and other features and effects of the present invention will be explained in more detail below with reference to drawings in which a preferred and illustrative embodiments of the invention are shown. The person skilled in the art will realize that other alternatives and equivalent embodiments of the invention can be conceived and reduced to practice without departing from the scope of the present invention.

DETAILED DESCRIPTION OF THE INVENTION

In the figures, numerals refer to similar components.

Figure 1:
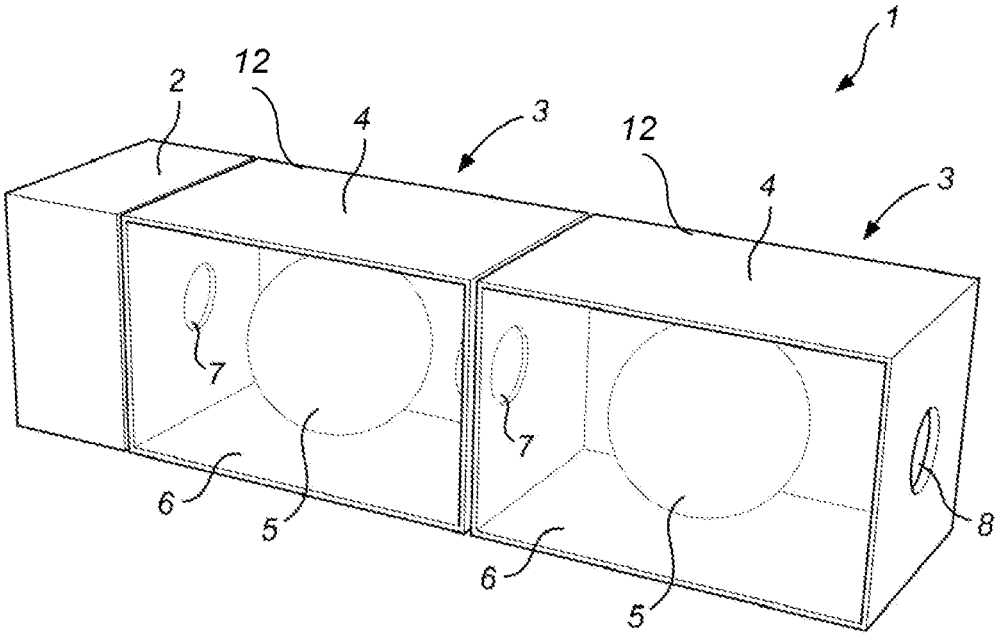
FIG. 1 shows a schematic illustration of a lighting system and module.

FIG. 1 shows a schematic view of a lighting system 1. The lighting system can be used for street lighting. The lighting system 1 comprises, for example, two modules 3, each module comprises a housing 12 and a light emitting diode (LED) 5. The housing is provided with a peripheral wall 4 and a light exit window 6. The light exit window 6 can be provided with a transparent sheet of material 6, for example, polymethylmeta-acrylate (PMMA) to obtain a waterproof and dustproot module. The peripheral wall 4 can have a rectangular cross-section. The peripheral wall 4 can be made of a plastic material e.g. ABS or PVC.

The module 3 further comprises a controller 2 for driving the LEDs.

A light output of in the range of 5-25 klm with a required granularity can be obtained with a lighting system comprising, for example, 2 or 3 LED modules.

In an embodiment the lighting system can have an equal nominal light output per modules. In a further embodiment the light output of the individual modules can be different, and may have a fixed value that can be, for example, 1, 3, 5, 10 or 20 klm. Each module comprises a sufficient number of LEDs to match the nominal light output of the module when applied in the lighting system. The modules can be used separately as a luminaire and can be sold separately an end user or consumer.

Figure 2:
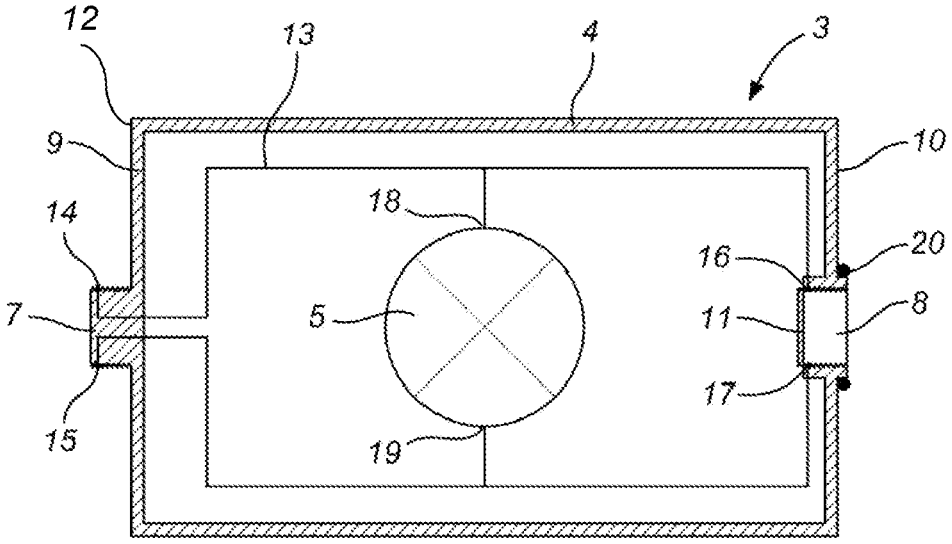
FIG. 2 shows a schematic illustration of a module according to a first embodiment.

FIG. 2 shows a schematic view of a module 3 according to a first embodiment for use in this lighting system 1. The other module 3 of the lighting system can be similar to the described module 3. The module 3 comprises for example, a block shaped housing having a peripheral wall 4, which is closed at one and provided with the light exit window 6. The other end can be provided with a transparent bottom 6, the material of the bottom can be, for example, polymethylmeta-acrylate (PMMA) to obtain a waterproof and dustproof module. The peripheral wall 4 can have a rectangular cross-section. The top and the peripheral wall 4 can be made of a plastic material e.g. ABS or PVC.

The module 3 further comprises a first connector and a second connector. The first connector, for example, a screw 7 is provided in a first side 9 of the peripheral wall 4. The second connector, in this embodiment, a screw nut or threaded hole 8 is provided in a second side 10 of the peripheral wall 4 opposite the screw 7 in the first side 9, wherein the threaded hole is made in the second side 10. The screw 7 and the screw nut or threaded hole 8 can be integrally formed with the peripheral wall 4 of the housing. In an embodiment a rigid material can be used for the housing of the modules 3 and the chain of modules in the lighting system can be rigid and conforming to a substantially straight line.

A removable lid portion 11 of the housing 12 may located at the inner end the screw nut or threaded hole 8. The lid portion can be formed by a portion surrounded by a line of weakness in the material of the peripheral wall. Alternatively, the removable lid portion 11 can be made of a thinner wall portion of the material of the housing 12, so that the removable portion can be easily removed from the housing. For example, by inserting the screw 7 of a second module in the threaded hole 8 of the first module and break the lid 11 while engaging the modules 3 to each other.

The module 3 further comprises a first electrical circuit 13 to connect the LEDs 5 in the lighting system in parallel. The first electrical circuit 13 comprises a first pair of a first and a second electrical contact 14,15 formed by respective copper portions provided opposite to each other at the outer circumference of an end of the screw 7. Furthermore, the first electrical circuit comprises a second pair of electrical contacts of a third and a fourth electrical contact 16,17 formed by respective copper portions, which are separated from each other and located at opposite sides inside the housing at the inner circumference of the screw nut 8 for engaging with the first and second contacts 14,15 of the screw 7 of a second module 3.

In the first electrical circuit 13 a first contact 14 at the screw 7 is connected to a third 16 contact of the screw nut 8 via a first contact of the LED 5, and a second contact 15 at the screw 7 is connected to a fourth contact 17 of the screw nut 8 via a second contact 19 of the LED 5. In a further embodiment more LEDs 5 can be electrically connected to the first LED 5, for example, in series or parallel connection or in a combination of serial and parallel connections.

The lighting system 1 can be assembled by subsequently mounting the modules 3 according to the first embodiment, starting with the first module and the second module. The first electrical circuit 13 in the first module 3 is connected to the controller 2 of the lighting system via the contacts 14,15 in the screw 7.

Then, the lid portion 11 of the first module 3 is removed from the housing, for example, by engaging the screw 7 of a second module 3 in the screw nut 8 of the first module. The respective third and fourth contacts 16,17 of the screw nut 8 of the first module are then electrically connected with the respective first and second contacts 14, 15 of the screw 7 of the second module, The screw 7 and the screw nut 8 enables releasably electrically and mechanically mounting of the modules 3, so that the modules can be easily exchanged or the number of modules can be extended.

In this embodiment the LED 5 in the first module is connected in parallel with the LED 4 in the second module.

In a further embodiment of a lighting system a third module 3 can be connected to the second module and so on until a desired number of modules 3 is mounted in the system. In the assembled lighting system all the modules and LEDs may be aligned in the same direction.

The controller 2 of the lighting system driving modules according to this first embodiment is of a constant voltage mode. The controller 2 can be electrically connected with a mains or other power source. The electrical voltage of the power source, may be an AC mains voltage, e.g. 230V, 50 Hz, or a DC-Voltage from a DC-Grid, e.g. 400V. The controller 2 converts this voltage to a constant voltage for driving the LEDs 5.

In order to make a waterproof or dust proof connection between the first and second modules 3 a sealing 20, for example, an O-ring of resilient material, e.g. rubber or silicone material, can be provided between the screw 7 of the second module and the screw nut 8 of the first module.

Figure 3:
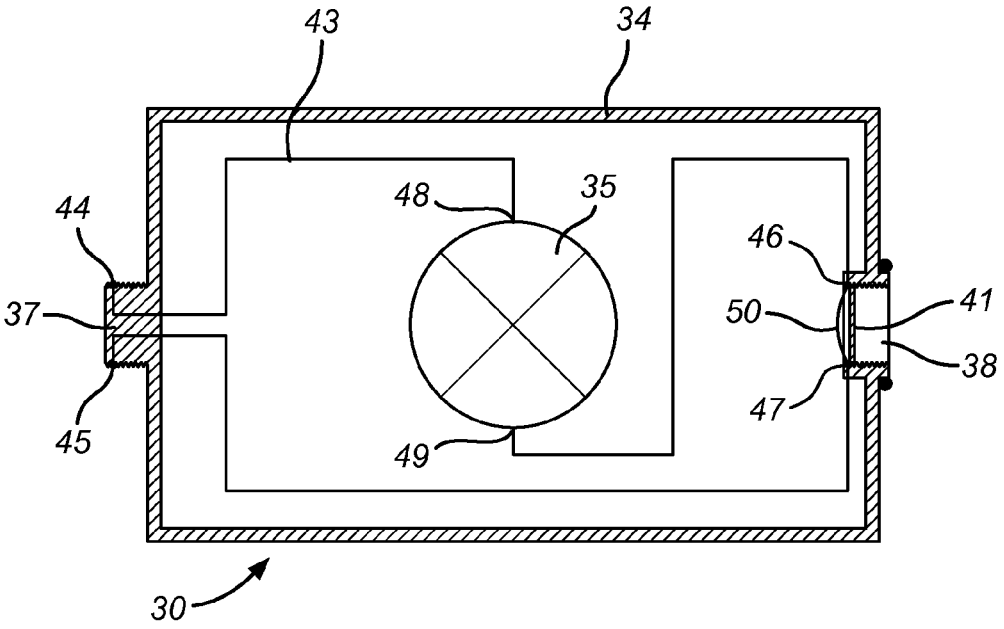
FIG. 3 shows a schematic illustration of a module according to a second embodiment.

FIG. 3 shows a schematic view of a module 30 according to a second embodiment. This module 30 is mechanically similar to the module 3 according to the first embodiment. This module 30 comprises a second electrical circuit 43 to connect the LEDs 35 in the lighting system 1 in series. The second electrical circuit 43 is provided with a first pair of a first and a second electrical contacts 44,45 arranged opposite to each other at the outer circumference of the screw 37 and a second pair of a third and a fourth electrical contacts 46,47 formed by respective copper portions, which are separated from each other and located at opposite sides at the inner circumference of the screw nut or thread hole 38 and a removable electrical conductor, for example a copper wire 50, connecting the third and fourth contacts 46,47 of the screw nut or thread hole 38 with each other. The copper wire 50 may be attached to the removable lid portion 41 and the diameter of the copper wire is such that it can be easily broken away when the lid portion 41 is removed.

In the second electrical circuit 43 the first contact 44 of the screw 37 is connected to an first contact 48 of the LED 35, and a second contact 45 of the screw 37 is connected to a second contact 49 of the LED via the fourth contact 47, the copper wire 50 and the first contact 46 inside the screw nut 38. In an embodiment more LEDs 35 can be connected to each other. For example in series or parallel connection or in a combination of serial and parallel connections.

The lighting system 1 can be assembled by subsequently mounting the modules 30 according to the second embodiment, starting with a first module 30 and a second module 30. The second electrical circuit 43 of the first module 30 is connected to the controller 2 via the first and second contacts 44,45 in the screw 37 of the first connector. Then, the lid portion 41 of the first module 30 is removed, for example by engaging the screw 37 of the third connector of the second module 30 in the screw nut or thread hole 38 of the second connector of the first module 30, whereby the third connector and the third pair of contacts is identical to the second connector and the second pair of contacts. When the screw 37 of the second module is engaged with the screw nut or thread hole 38, the copper wire 50 between the third and fourth electrical contacts 46,47 of the screw nut 38 of the first module 30 is broken or removed and the respective third and fourth contacts 46,47 of the screw nut or thread hole 38 of the first module 30 are electrically connected with the first and second contacts 44,45 of the screw 37 of the second module 30. In this second embodiment the LED 35 in the first module is connected in series with the LED 35 in the second module. Subsequently, a third module can be connected to the second module and so on to assemble the lighting system. In the last module 30 of the lighting system 1 the electrical system comprises the copper wire 50 to close the second electrical circuit 43. In the assembled lighting system all the modules, the light exit windows and LEDs 35 may be aligned in the same direction.

The controller 2 of the lighting system driving the modules 30 according to this second embodiment is of a constant current mode and is connected to a conventional mains or other power source. The electrical voltage of the power source, may be an AC mains voltage, e.g. 230V, 50 Hz, or a DC-Voltage from a DC-Grid, e.g. 400V. The controller 2 converts this voltage to a constant voltage for driving the LEDs 5.

Figure 4:
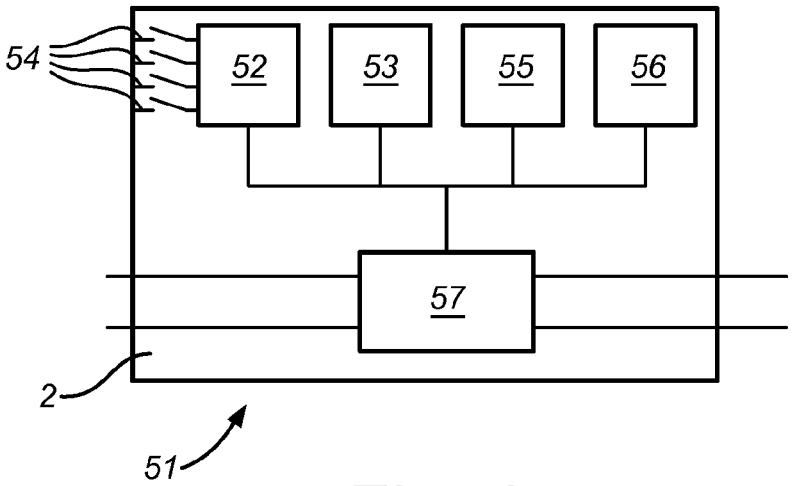
FIG. 4 shows a schematic diagram of a controller for use in a lighting system.

FIG. 4 shows a schematic diagram of a controller 2 for use in the lighting system 1. The controller 2 may be provided with a processor 53 with a storage device 52 for storing a current electrical load of the lighting system, the storage can comprise, for example electrical switches 54, that can be used to select the electrical load of the lighting system 1. In combination or alternatively, some means of measuring the supply voltage and/or current required for any or all of the series or parallel connected modules can be used, which drive (e.g. by providing signals to the controllers 2 representative of the actual electrical load of the lighting system 1) the power controlled by the processor 53 or controller 2, without necessarily taking into account the number of LEDs present in the lighting system 1. This electrical load may be stored in the storage device 52 and periodically updated. This storage device 52 may be further arranged for generating, optionally periodically, a signal to the processor 53 indicating the current electrical load of the lighting system 1. The controller 2 is further provided with a power driver 57 for driving the arrangement of LEDs 5 according to a required power. The power driver is arranged to drive the LEDs in a constant voltage mode or a constant current mode. The processor 53 is further arranged to interpret the received signal and to adjust accordingly the power to the modules 3 via the power driver 55. The controller 2 may also be provided with a counter 55 for counting the accumulated operating time of the lighting system 1 and a further memory 56 for storage of the accumulated operation of the lighting system. The processor 53 can be further arranged that after a certain period of accumulated operating time, for example 3000 hrs, the power to the LEDs 5 in the modules 3 is increased to compensate for a decreasing light output of the LEDs due to ageing of the LEDs. In the embodiments described so far, the controller, providing a suitable driver voltage or current for the LEDs, was located outside the modules, e.g. as shown with the controller 2 in FIG. 1. In these embodiments, the driver has to be designed for a certain number of modules and has to adapt its output voltage or current to the number of module (and the ageing state).

Figure 5:
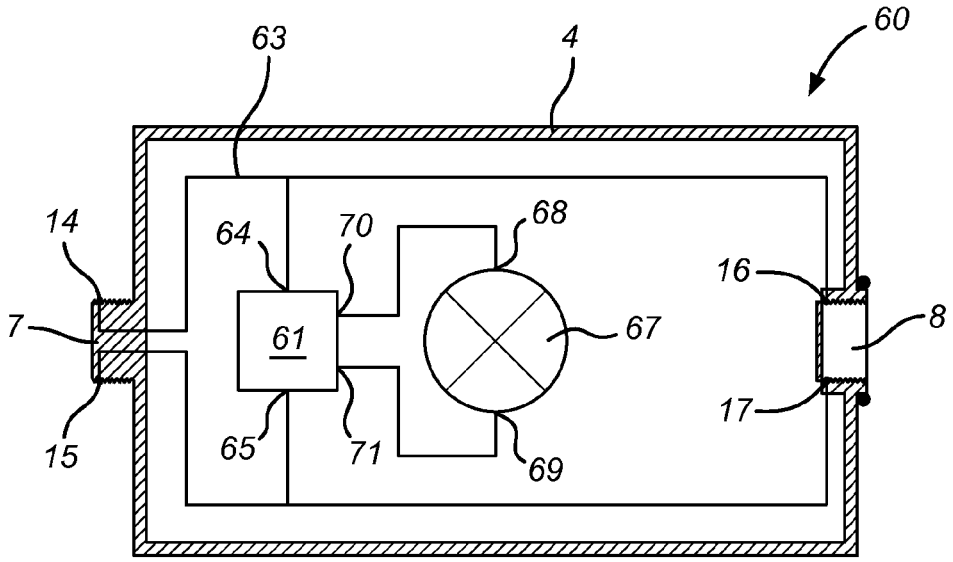
FIG. 5 shows a schematic illustration of a module according to a third embodiment.

FIG. 5 shows a schematic view of a module 60 according to a third embodiment. The module 60 may be mechanically similar to the module 3 according to the first embodiment or second embodiment. The third electrical circuit 63 differs from the electrical circuits in the first and second embodiment. The third electrical circuit comprises a separate module controller 61 for driving the one or more LEDs 68 in the module 60. Thereto a first contact 64 of the module controller 61 is connected with respectively the first contact 14 at the screw 7 and the third contact 16 of the screw nut 8 of the module 60 and a second contact 65 of the module controller 61 is connected with respectively the second contact 15 of the screw 7 and the fourth contact 17 of the screw nut 8. The first contact 68 and the second contact 19 of the LED 68 are connected to a first and a second output 70,71 of the module controller 61.

The module controller 61 can comprise similar elements as the controller 2. Furthermore, the module controller 61 can be further arranged that after a predetermined period of accumulated operating time, e.g. 3000 hrs, the power to the LEDs 68 in the module is increased to compensate for a decreasing light output of the individual LEDs due to ageing of the LEDs.

The electrical voltage that may be received via the contacts 14 and 15 may be an AC mains voltage, e.g. 230V, 50 Hz, or a DC-Voltage from a DC-Grid, e.g. 400V. This voltage is not always suited to directly drive the LEDs 68. In the previous embodiments, the adaption was performed by the controller 2 (FIG. 1). In this embodiment the module controller to drive the LEDs 68, is located in the module. Different modules might have different LEDs 68 and different module controllers 61, but may receive the same voltage via the contacts 14 and 15. The module controller 61 in a module can be optimized for the number of LEDs used in the module. Typical electronic architectures for this module controllers for this application are known to a person skilled in the art. The electronic architectures can comprise, for example, a resistive (linear) driver or a switch mode power supply.

A module 4 may again have means to measure and store the operation hours. There may also be means to detect if a further module that is connected to the contacts 16 and 17.

Figure 6:
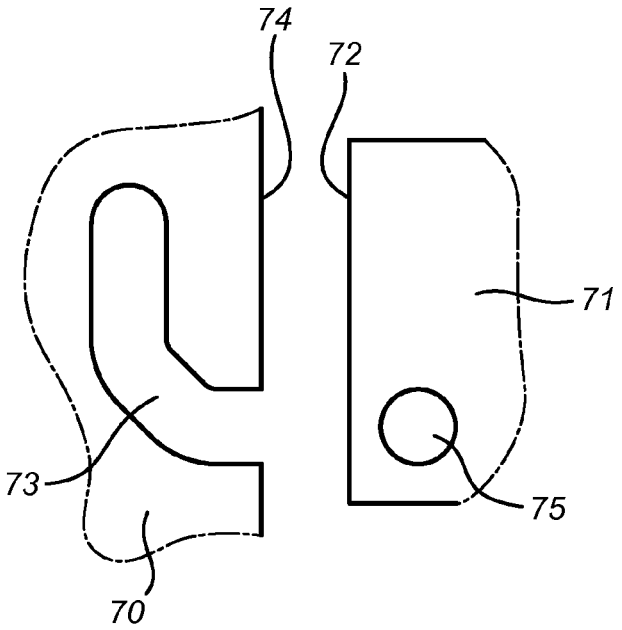
FIG. 6 shows a schematic illustration of cooperating bayonet connectors.

In the described embodiments the first connecter comprises a screw and the second connector comprises a screw nut. In the described embodiments instead of the screw and the screw nut, bayonet type connectors can be used. FIG. 6 shows a schematic view of a first connector 70 and a cooperation second connector 71, both of the bayonet type. A first circumferential wall 72 of the first connector 70 is provided with a slot 73. A second circumferential wall 74 of the second connector 71 is provided with a cam 75 for engaging in the slot 74 of the first connector 70.

The use of the bayonet connectors 70,71 ensures alignment of modules 3, such that the pair of contacts of the modules 3 are in a defined position and have sufficient contact pressure, overlap or clearance to other circuits as is well known to a person skilled in the art.

In the described embodiments, proper alignment of the pairs of electrical contacts 14,15; 16,17 can also be achieved with a screw connection or other connection, e.g. by having a well defined block. Alignment of the electrical contacts may be decoupled from the alignment of the light output direction of the module. The module 3 may have a rotatable or flexible portion to allow a flexible positioning of the light output direction of each module, while the connectors 7,8,70,71 for mechanical and electrical contact and sealing stay in a predefined orientation.

Instead of bayonet connectors 70,71 also press-fitting connectors can be used in the described embodiments of the modules 3.

Although illustrative embodiments of the present invention have been described with reference to the accompanying drawings, it is to be understood that the invention is not limited to these embodiments. Various changes or modifications may be effected by one skilled in the art without departing from the scope or the spirit of the invention as defined in the claims. Accordingly, reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that the particular features, structures, or characteristics may be combined in any suitable manner in one or more embodiments.

The invention claimed is:

1. A lighting system comprising a plurality of modules, wherein each module comprises a housing provided with an exit window, wherein the housing is provided with a removable portion in a peripheral wall of the housing;

at least one light source provided in the housing;

wherein the lighting system further comprises:

a controller arranged to drive the light sources; and an electrical circuit in each module arranged to connect the light sources with the controller;

wherein the electrical circuit of a first module further comprises a first pair of electrical contacts and the electrical circuit of a second module further comprises a second pair of electrical contacts, the first and second pair of contacts being arranged for a mutual electrical connection;

wherein the first module further comprises a first connector provided with the first pair of electrical contacts and the second module further comprises a second connector provided with the second pair of electrical contacts, the first and second connectors being arranged to cooperate so as to mount the first and second modules to each other and to implement said mutual electrical connection, and wherein the electrical circuit further comprises a removable electrical conductor between the electrical contacts of the second pair of electrical contacts in the second module.

2. A lighting system according to claim 1, wherein the first module further comprises a third connector provided with a third pair of electrical contacts.

3. A lighting system according to claim 2, wherein the third connector is positioned on a side of the housing opposite the side where the first connector is provided.

4. A lighting system according to claim 2 wherein the first connector and the third connector are integrally formed in a peripheral wall of the housing of the first module.

5. A lighting system according to claim 1 wherein a sealing is provided between the first connector and the second connector.

6. A lighting system according to claim 1, further comprising a device arranged to accumulate the operating time of the lighting system, a memory to store the accumulated operating time, and wherein the controller is further arranged to adjust the power of the light sources in the lighting system in dependency of the accumulated operating time of the lighting system.

7. A lighting system according to claim 1 wherein the light output of a module is one of 1, 3, 5, 10 and 20 klm.

8. A lighting system according to claim 1 wherein the first and second connectors are further arranged to cooperate so as to releasably mount the first and second modules electrically and mechanically to each other.

9. A lighting system according to claim 1 wherein the electrical circuit of each module further comprises:

at least one pair of electrical contacts provided for implementing an electrical connection with a pair of electrical contacts of another module.

10. A lighting system comprising a plurality of modules, wherein each module comprises:

a housing provided with an exit window, wherein the housing is provided with a removable portion in a peripheral wall of the housing; and at least one light source provided in the housing;

wherein the lighting system further comprises:

a controller arranged to drive the light sources; and an electrical circuit in each module arranged to connect the light sources with the controller;

wherein the electrical circuit of a first module further comprises a first pair of electrical contacts and the electrical circuit of a second module further comprises a second pair of electrical contacts, the first and second pair of contacts being arranged for a mutual electrical connection;

wherein the first module further comprises a first connector provided with the first pair of electrical contacts and the second module further comprises a second connector provided with the second pair of electrical contacts, the first and second connectors being arranged to cooperate so as to mount the first and second modules to each other and to implement said mutual electrical connection;

wherein the lighting system further comprises a device arranged to generate a signal indicating a current electrical load of the lighting system.

11. A lighting system according to claim 10, wherein the controller is arranged to receive said signal and to adjust the power of the light sources accordingly.

12. A module for a lighting system, comprising:

a housing provided with a light exit window, wherein the housing is provided with a removable portion in a peripheral wall of the housing, at least one light source provided in the housing, a first connector provided with a first pair of electrical contacts and arranged to be cooperatively mounted to a third connector of a further module and to implement an electrical connection with a third pair of electrical contacts provided with the third connector, a second connector and a second pair of electrical contacts, the second connector and the second pair of contact being similar to the third connector and the third pair of electrical contacts, and wherein a removable electrical conductor is provided between the first or second pair of electrical contacts.

13. A module according to claim 12, wherein the removable electrical conductor is attached to the removable portion.

* * * * *